US007228864B2

(12) United States Patent
Tahara

(10) Patent No.: US 7,228,864 B2
(45) Date of Patent: Jun. 12, 2007

(54) COSMETIC CONTAINER

(75) Inventor: Tomio Tahara, Tokyo (JP)

(73) Assignee: Kamaya Kagaku Kogyo Co., Ltd. (JP)

( * ) Notice: Subject to any disclaimer, the term of this patent is extended or adjusted under 35 U.S.C. 154(b) by 350 days.

(21) Appl. No.: 10/384,616

(22) Filed: Mar. 11, 2003

(65) Prior Publication Data

US 2004/0089318 A1 May 13, 2004

(30) Foreign Application Priority Data

Nov. 13, 2002 (JP) ..... 2002-329517

(51) Int. Cl.
*A45D 44/18* (2006.01)

(52) U.S. Cl. ..... 132/313; 401/117

(58) Field of Classification Search ..... 132/293, 132/317, 290, 294, 313, 286; 401/129, 127, 401/77, 78, 87, 116, 117, 184; 15/106, 144.4, 15/286, 159.1, 184

See application file for complete search history.

(56) References Cited

U.S. PATENT DOCUMENTS 1,182,235 A * 5/1916 Amrock ..... 15/184
1,422,787 A * 7/1922 Rope ..... 132/290
3,308,939 A * 3/1967 Sakalys ..... 401/78
3,694,096 A * 9/1972 Seidler ..... 401/127
4,842,132 A * 6/1989 Wells ..... 206/229
5,186,561 A * 2/1993 Ackermann et al. ..... 401/78
5,339,483 A * 8/1994 Byun ..... 15/184
5,851,078 A * 12/1998 Bow et al. ..... 401/78
6,234,181 B1 * 5/2001 Lou ..... 132/313

FOREIGN PATENT DOCUMENTS

JP 1990-25918 A1 2/1990
JP 1991-128018 A1 12/1991

* cited by examiner

*Primary Examiner*—Todd E. Manahan
(74) *Attorney, Agent, or Firm*—Rader, Fishman, & Grauer PLLC

(57) ABSTRACT

Cosmetic brush (11) is extensibly received in cosmetic container to pick up cosmetic (2) from lid (1) without being damaged. Lid (1) is engaged with and disengaged from body (10) without fail. Body (10) is constructed of: lift sleeve (14) holding the brush (11); intermediate sleeve (15) with neck (17) cooperating with lid (1) to realize threadable engagement therebetween; and outer sleeve (25) with spiral groove (26) which is a part of a telescopic mechanism for extending and retracting the brush (11) from intermediate sleeve (15). Threadable engagement is larger in frictional resistance than the telescopic mechanism to make it possible: to move first the brush (11) when the lid (1) is rotated; and, then to disengage the lid (1) from intermediate sleeve (15) after the brush (11) press-contacts with the cosmetic (2) and is prevented from moving upward.

6 Claims, 11 Drawing Sheets

COSMETIC CONTAINER

BACKGROUND OF THE INVENTION

1. Field of the Invention

The present invention relates to a cosmetic container of a stick type, which is suitable for portable use and constructed of: a lid element which holds therein a cosmetic such as a solid one, a powdered one such as a cheek rouge, a presto powder, a face powder and like cosmetics; and, a main body element engaged with the lid element, wherein a cosmetic brush is extensibly mounted in the main body element and extended upward from the main body element by means of a telescopic mechanism of the main body element when the cosmetic stored in the lid element is picked up by the cosmetic brush in use.

2. Description of the Related Art

One of conventional cosmetic containers of a stick type is disclosed in Japanese Utility Model Publication No. Hei 6-30106, for example. This conventional one comprises an applicator container and a cosmetic container. The applicator container (herein after referred to as "main body element") stores therein an applicator (hereinafter referred to as "cosmetic brush"), wherein the cosmetic brush is extensibly mounted in the main body element and extended downward from the main body element by means of a telescopic mechanism of the main body element when a cosmetic stored in the lid element is picked up by the cosmetic brush.

In use, the cosmetic brush is extended downward from the main body element by operating the telescopic mechanism of the main body element to have a lower end portion of the cosmetic brush brought into press-contact with the cosmetic of the lid element, so that the cosmetic in the lid element is partially transferred to the lower end portion of the cosmetic brush through frictional contact between the cosmetic and the cosmetic brush. The operation the telescopic mechanism of the main body element described above is effected by rotating the main body element relative to the lid element held stationary. Under such circumstances, the cosmetic brush is further extended downward from the main body element.

Due to this, the main body element is pushed upward relative to the lid element as a result of the reaction to the cosmetic brush's downward push on the cosmetic of the lid element held stationary by the user, so that the main body element has an engaging portion of its sleeve component disengaged from the lid element. At this time, since the cosmetic brush has already picked up the cosmetic of the lid element through friction contact between the cosmetic brush and the cosmetic stored in the lid element, it is possible for the user to apply the thus picked up cosmetic to his or her face using the cosmetic brush.

However, the conventional cosmetic container suffers from serious damage to the cosmetic brush resulted from failure in disengagement of the main body element from the lid element. More specifically, in use, the main body element is rotated relative to the lid element to move its cosmetic brush downward and brought into press-contact with the cosmetic stored in the lid element. At this time, when the user does not pull up the main body relative to the lid element held stationary by the user, further rotation of the main body element relative to the lid element leads to the cosmetic brush's excessive pressure onto the cosmetic in the lid element, which causes seriously damage to the cosmetic brush. One of examples of such serious damage to the cosmetic brush is a mushroom-like deformation of the lower portion of the cosmetic brush.

In addition to the above problem, the above-mentioned further rotation of the main body element relative to the lid element also leads to transfer of an excessive amount of the cosmetic to the cosmetic brush in use. Such excessive transfer of the cosmetic to the cosmetic brush is further enhanced by the mushroom-like deformation of the lower portion of the cosmetic brush.

Further, after use of the conventional cosmetic container, when the main body element is engaged again with the lid element, there is a fear that a considerable amount of the cosmetic is emitted from the lid element due to a so-called "piston effect" of the main body element inserted into the lid element. This is further another problem inherent in the conventional cosmetic container.

SUMMARY OF THE INVENTION

Under such circumstances, the present invention was made to solve the problems inherent in the prior art. Consequently, it is an object of the present invention to provide a cosmetic container of a stick type, which is suitable for portable use and constructed of: a lid element holding therein a cosmetic; and, a main body element engaged with the lid element, wherein a cosmetic brush is extensibly mounted in the main body element and extended upward from the main body element by means of a telescopic mechanism of the main body element when the cosmetic stored in the lid element is picked up by the cosmetic brush in use, wherein the cosmetic brush is free from any damage to the cosmetic brush and the cosmetic container is capable of having the lid element forcibly disengaged from the main body element without fail at the end of further rotation of the main body element relative to the lid element.

In accordance with the present invention, the above object of the present invention is accomplished by providing:

A cosmetic container comprising: a lid element (1) provided with an innermost portion and an opening portion (3*a*), stored in which innermost portion is a cosmetic (2), the opening portion (3) being provided with a fitting engagement portion; and, a main body element (10), in which a cosmetic brush (11) is extensibly mounted, the main body element (10) being capable of engaging with the lid element (1) in an insertion manner, CHARACTERIZED IN THAT:

the main body element (10) is provided with a telescopic mechanism for extending and retracting the cosmetic brush (11) from an upper opening of an intermediate sleeve (15), the telescopic mechanism being constructed of: a lift sleeve (14) provided with a protrusion (13) extending radially outwardly from an outer peripheral surface of the lift sleeve (14) mounted in which a cosmetic brush (11); the intermediate sleeve (15) in which the lift sleeve (14) is axially slidably received, the intermediate sleeve (15) being provided with a neck portion (17) in its upper portion and a sleeve portion (16) in its lower portion, wherein the sleeve portion (16) is provided with an elongated axial guide groove (21) in its peripheral wall for axially slidably receiving therein the protrusion (13) of the lift sleeve (14) and the neck portion (17) is provided with an engagement portion which is engaged with a corresponding engagement portion of the lid element (1) to form a fitting engagement mechanism (3) through which the intermediate sleeve (15) is engaged with the lid element (1) in an insertion manner; and, an outer sleeve (25) in which the intermediate sleeve (15) is rotatably but not axially movably mounted, the outer sleeve (25) being provided with a spiral groove (26) in its inner peripheral surface, in which spiral groove (26) the protrusion (13) of the lid element (1) is slidably received through the axial guide groove (21) of the intermediate sleeve (15), wherein the telescopic mechanism of the main body element (10) is smaller in frictional resistance in rotation than the fitting engagement mechanism (3) through which the intermediate sleeve (15) is engaged with the lid element (1) in an insertion manner.

In the cosmetic container of the present invention having the above construction, it is possible to continuously perform a pick-up operation of the cosmetic (2) from the lid element (1) and a removable operation of the lid element (2) from the main body element (10) by simply rotating the lid element (1) in the same direction relative to the main body element (10).

In the cosmetic container of the present invention, preferably the fitting engagement mechanism (3) is constructed of: a female screw (5) formed in an inner peripheral surface of the opening portion (3*a*) of the lid element (1); and, a male screw (18), which is formed in an outer peripheral surface of the neck portion (17) of the intermediate sleeve (15) and threadably engaged with the female screw (5) of the lid element (1). The above-mentioned threadable engagement between the lid element (1) and the intermediate sleeve (15) may improve the cosmetic container in its sealing properties to ensure that the cosmetic (2) does not leak from the container. Due to such provision of the threadable engagement between the lid element (1) and the intermediate sleeve (15), the cosmetic container of the present invention is free from a fear that the lid element (1) is kept at an idle in its removal operation from the main body element (10).

Further, preferably, the fitting engagement mechanism (3) is constructed of: an undercut engagement (9) between the lid element (1) and the main body element (10); and, a cam mechanism for disengaging the undercut engagement.

Still further, preferably, the fitting engagement mechanism (3) is constructed of: a pin (38) fixedly mounted in the lid element (1) to extend radially; and, an L-shaped slot (39) formed in the intermediate sleeve (15) to slidably receive therein the pin (38) of the lid element (1), the L-shaped slot (39) comprising an oblique guide portion (33) and a locking rib (35), wherein the oblique guide portion (33) of the L-shaped slot (39) functions to guide the pin (38) of the lid element (1) upward relative to the intermediate sleeve (15), wherein, when the lid element (1) is rotated so as to have the pin (38) slidably moved in the length of the L-shaped slot (39) toward an innermost portion (34) of the L-shaped slot (39), the pin (38) is brought into press-contact with the locking rib (35), and then radially pushed by the locking rib (35) to ride across the locking rib (35) to enter the innermost portion (34) of the slot (39) due to the resiliency of the lid element (1), wherein, once the pin (38) of the lid element (1) enters the innermost portion (34) of the L-shaped slot (39), the pin 38 immediately returns to its normal position due to the resiliency of the lid element (1) and is locked to the innermost portion (34) of the L-shaped slot (39).

Further, preferably, the lid element (1) is constructed of: a cap member (37) filled with the cosmetic (2); and, a barrel portion (6*a*) of the lid element (1), the barrel portion (6*a*) being engaged with the cap member (37) through undercut engagement (9) in which an annular ridge portion formed in an outer peripheral surface of the cap member (37) is fitted in an annular groove formed in an inner peripheral surface of the barrel portion (6*a*) of the lid element (1).

Preferably, the lid element (1) is provided with an annular convergent guide portion (28) in its inner peripheral surface, through which convergent guide portion (28) the cosmetic brush (11) has its upper end portion converged radially inwardly toward a longitudinal axis of the lid element (1).

BRIEF DESCRIPTION OF THE DRAWINGS

The above and other objects, advantages and features of the present invention will be more apparent from the following description taken in conjunction with the accompanying drawings in which.

DETAILED DESCRIPTION OF THE PREFERRED EMBODIMENTS

The best modes for carrying out the present invention will be described in detail using embodiments of the present invention with reference to the accompanying drawings.

First Embodiment

Figure 1:
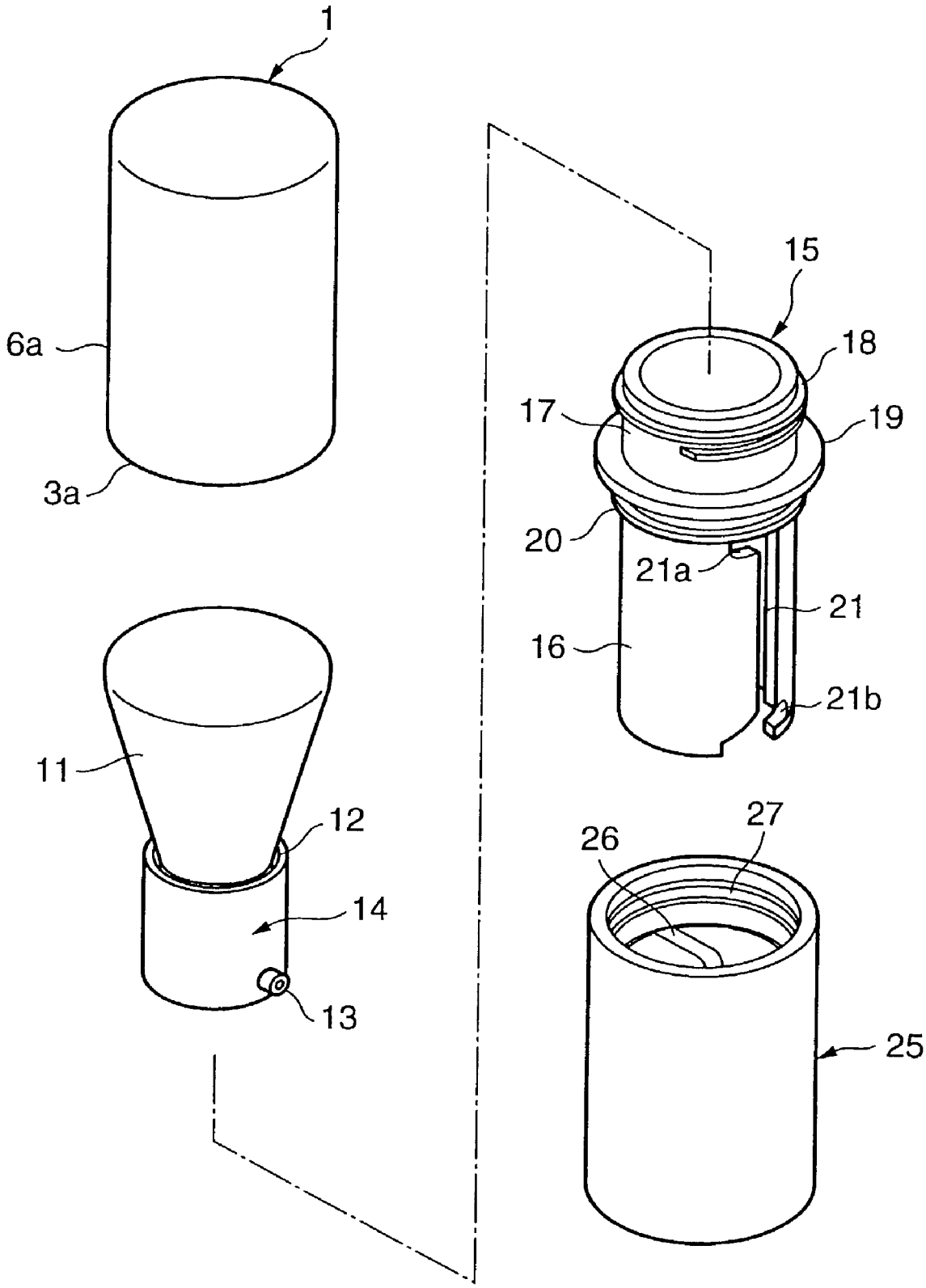
FIG. 1 is an exploded perspective view of a first embodiment of the cosmetic container of the present invention.
Figure 2:
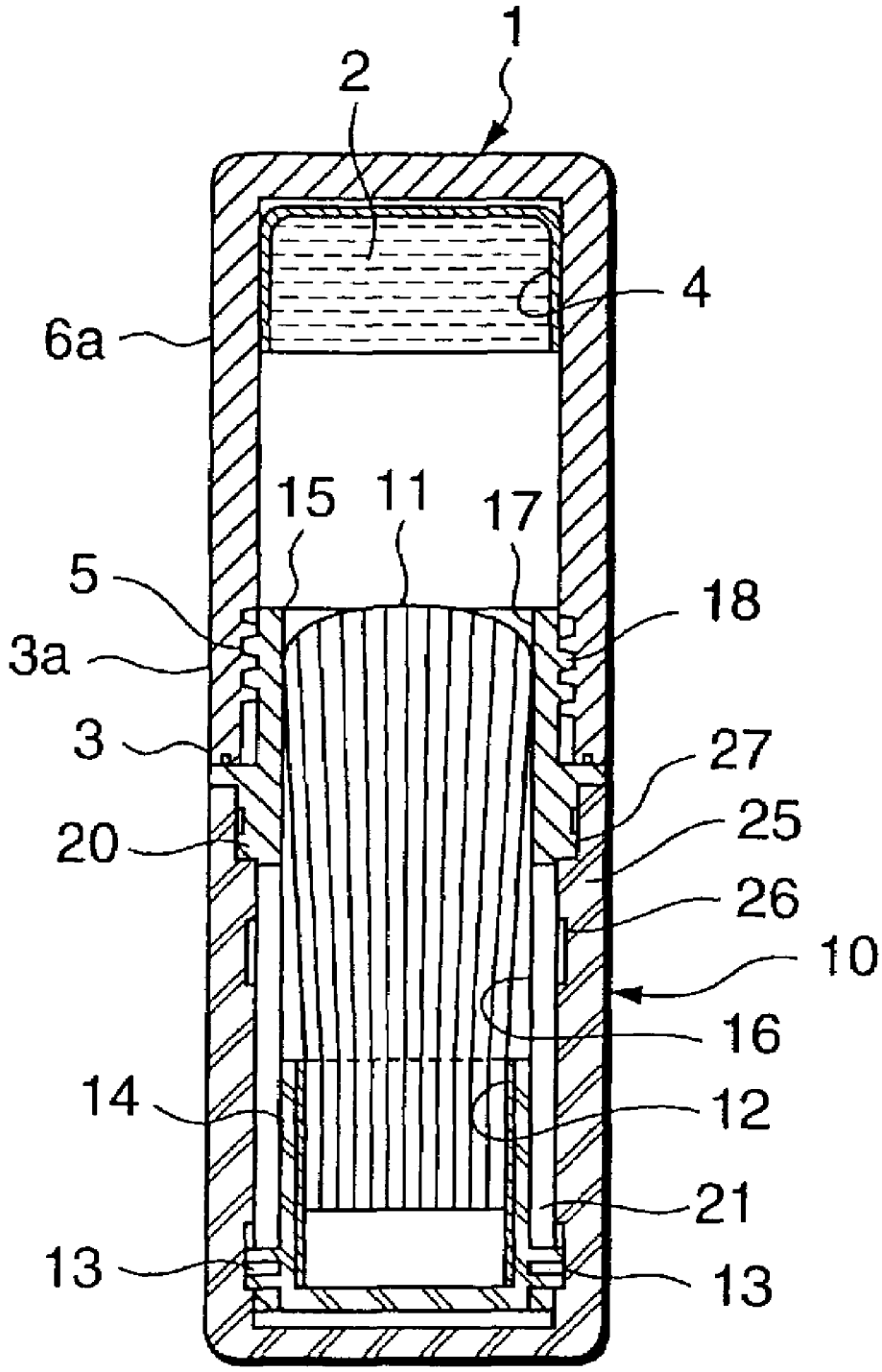
FIG. 2 is a longitudinal sectional view of the cosmetic container of the present invention shown in FIG. 1, illustrating the cosmetic container after completion of its assembly work.

FIGS. 1 to 5 show a first embodiment of a cosmetic container of the present invention. As shown in FIG. 2, the cosmetic container of the present invention is constructed of a lid element 1 and a main body element 10 which is engaged with the lid element 1 in an insertion manner. The lid element 1 is provided with an innermost portion and an opening portion 3*a*. Stored in the innermost portion of the lid element 1 is a cosmetic 2. On the other hand, a cosmetic brush 11 for applying the cosmetic 2 to the user's skin is extensibly received in the main body element 10.

The lid element 1 assumes a closed-top sleeve-like shape and is provided with the cosmetic 2 in its innermost portion. The cosmetic 2 made of a presto powder is filled in an inner dish 4 which is fixedly mounted in the innermost portion of the lid element 1. A female screw 5 is formed in an inner peripheral surface of the opening portion 3*a* of the lid element 1 to form a fitting engagement mechanism 3 through which the lid element 1 is engaged with the main body element 10.

The cosmetic brush 11 is constructed of a bundle of soft hairs, a lower end portion of which bundle is firmly clamped by a ferrule 12, as is clear from FIG. 2.

The main body element 10 is constructed of a lift sleeve 14, an intermediate sleeve 15 and a closed-bottom outer sleeve 25. As shown in FIG. 1, the cosmetic brush 11 is fixedly mounted in a lift sleeve 14 which is provided with a pair of diametrically opposed protrusions 13 in an outer peripheral surface of its lower end portion. The intermediate sleeve 15 receives the lift sleeve 14 therein in a manner such that the lift sleeve 14 is vertically movable therein. On the other hand, the outer sleeve 25 receives the intermediate sleeve 15 therein in a manner such that the intermediate sleeve 15 is rotatable relative to the outer sleeve 25.

As is clear from FIG. 1, the intermediate sleeve 15 is provided with a sleeve portion 16 in its lower portion, in which sleeve portion 16 are provided a pair of diametrically opposed axially elongated guide slots 21 each provided with an upper horizontal stopper extension slot 21*a* and a lower horizontal stopper extension slot 21*b*. Further, as is clear from FIG. 1, the intermediate sleeve 15 is provided with a neck portion 17. Formed in an outer peripheral surface of an upper portion of the neck portion 17 is a male screw 18 which is threadably engaged with the female screw 5 of the lid element 1 to form a fitting engagement mechanism 3. The intermediate sleeve 15 is further provided with a flange portion 19 which is disposed adjacent to a lower end of the male screw 18. As is clear from FIG. 1, an annular ridge portion 20 is formed in an outer peripheral surface of the intermediate sleeve 15 so as to be disposed under the flange portion 17, and is rotatably engaged with the outer sleeve 25 through a so-called "undercut engagement" (which is shown by the reference numeral 9 in FIG. 12, for example). In this undercut engagement, the annular ridge portion 20 of the intermediate sleeve 15 is fitted in an annular groove 27 formed in an inner peripheral surface of an upper end portion of the out sleeve 25, as is clear from FIG. 1.

The outer sleeve 25 is provided with a spiral groove 26 in an inner peripheral surface of its intermediate portion. The spiral groove 26 of the outer sleeve 25 is larger in lead than the female screw 5 of the lid element 1. The protrusions 13 of the lift sleeve 14 pass through the guide slots 21 of the intermediate sleeve 15 to slidably engage with the spiral groove 26 of the outer sleeve 25. The outer sleeve 25 having the above construction cooperates with both the intermediate sleeve 15 and the lift sleeve 14 to form a telescopic mechanism for extending and retracting the cosmetic brush 11 of the main body element 10. As described above, the annular groove 27 is formed in an inner peripheral surface of an upper end portion of the out sleeve 23 and receives therein the annular ridge portion 20 of the intermediate sleeve 15 to realize the undercut engagement between the outer sleeve 25 and the intermediate sleeve 15.

The telescopic mechanism having the above construction is smaller, in torque required in rotation, than the fitting engagement mechanism 3 (i.e., threadable engagement mechanism) between the lid element 1 and the main body element 10. In other words, the lead in the threadable engagement mechanism 3 between the lid element land the main body element 10 is smaller than the lead in the telescopic mechanism of the cosmetic brush 11. Due to this, in opening the lid element 1, a frictional resistance between the lid element 1 and the main body element 10 is larger than a frictional resistance in the telescopic mechanism so that the telescopic mechanism is first operated.

Figure 3:
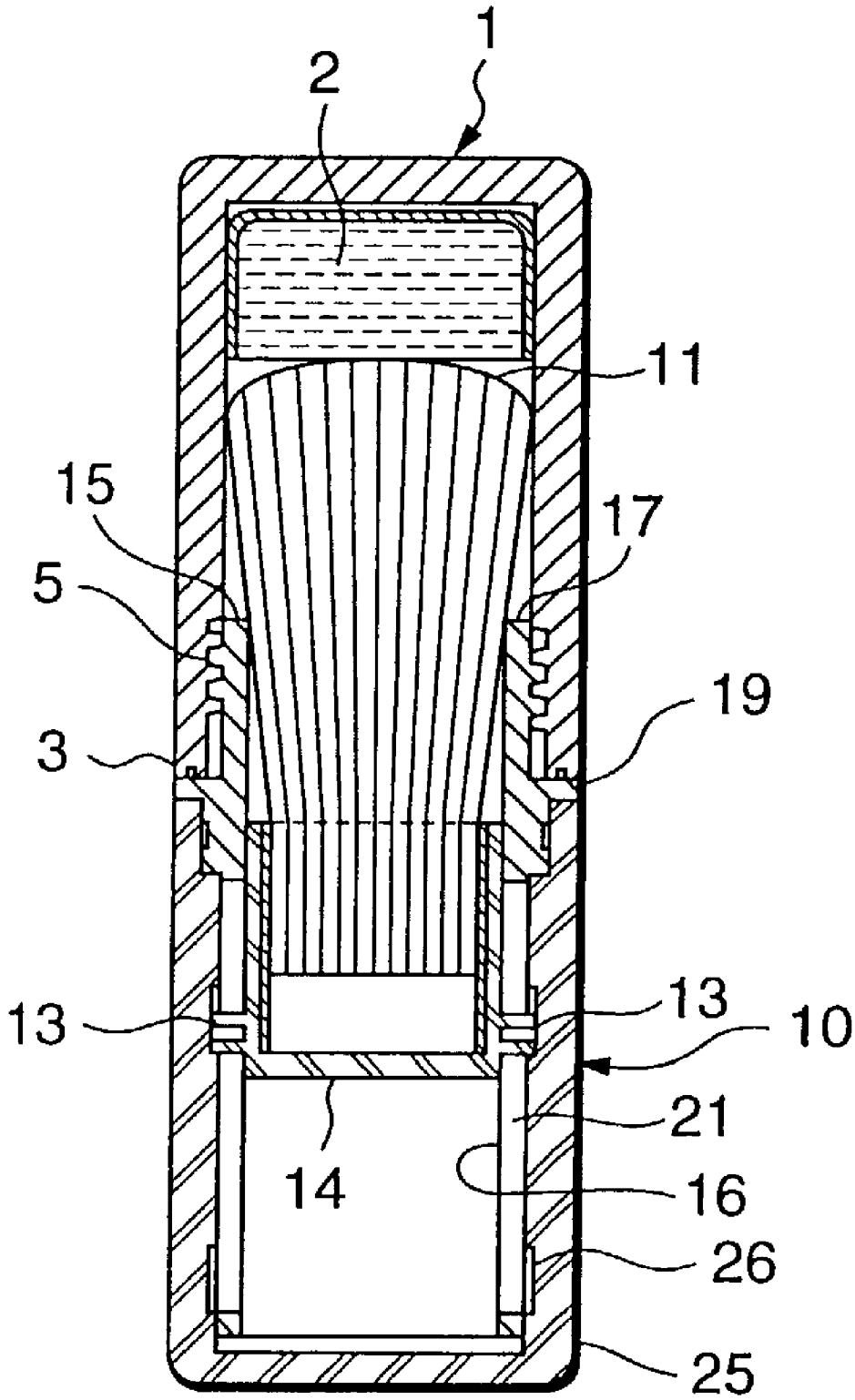
FIG. 3 is a longitudinal sectional view of the cosmetic container of the present invention shown in FIG. 1, illustrating the cosmetic container in which a cosmetic brush is moved up to have its upper portion brought into contact with a lower surface of a cosmetic stored in a lid member of the cosmetic container.

Consequently, when the lid element 1 is rotated relative to the main body element 10 so as to open the lid element 1, as shown in FIG. 3, the intermediate sleeve 15 is rotated together with the lid element 1 relative to the outer sleeve 25 to move upward the lift sleeve 14 relative to the outer sleeve 25. As is clear from FIG. 3, when an upper end portion of the cosmetic brush 11 is brought into press-contact with the cosmetic 2 of the lid element 1 so that a part of the cosmetic 2 is transferred to the upper end portion of the cosmetic brush 11, the intermediate sleeve 15 is prevented from rotating relative to the outer sleeve 25.

Figure 4:
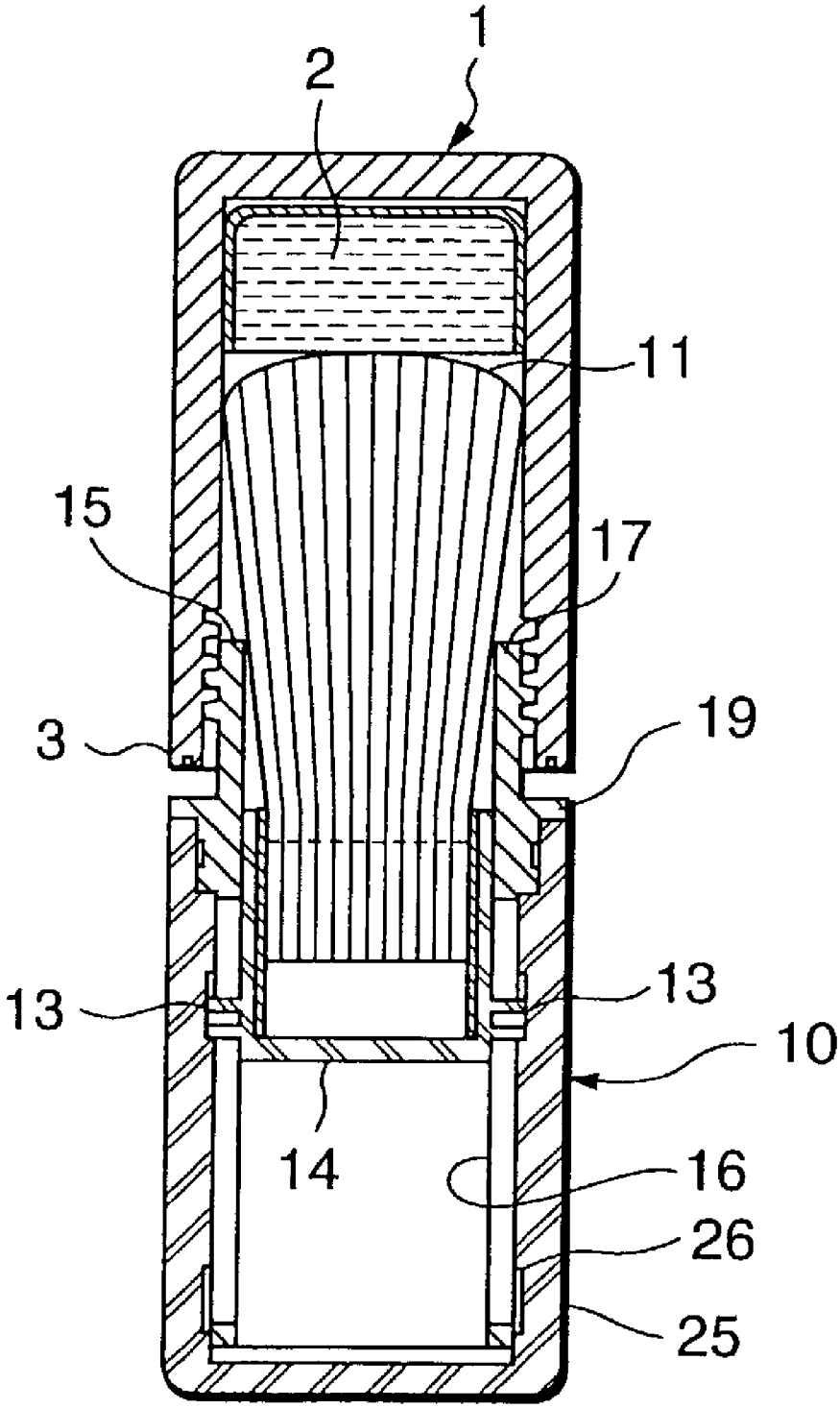
FIG. 4 is a longitudinal sectional view of the cosmetic container of the present invention shown in FIG. 1, illustrating the cosmetic container in which a cosmetic brush is further moved up.
Figure 5:
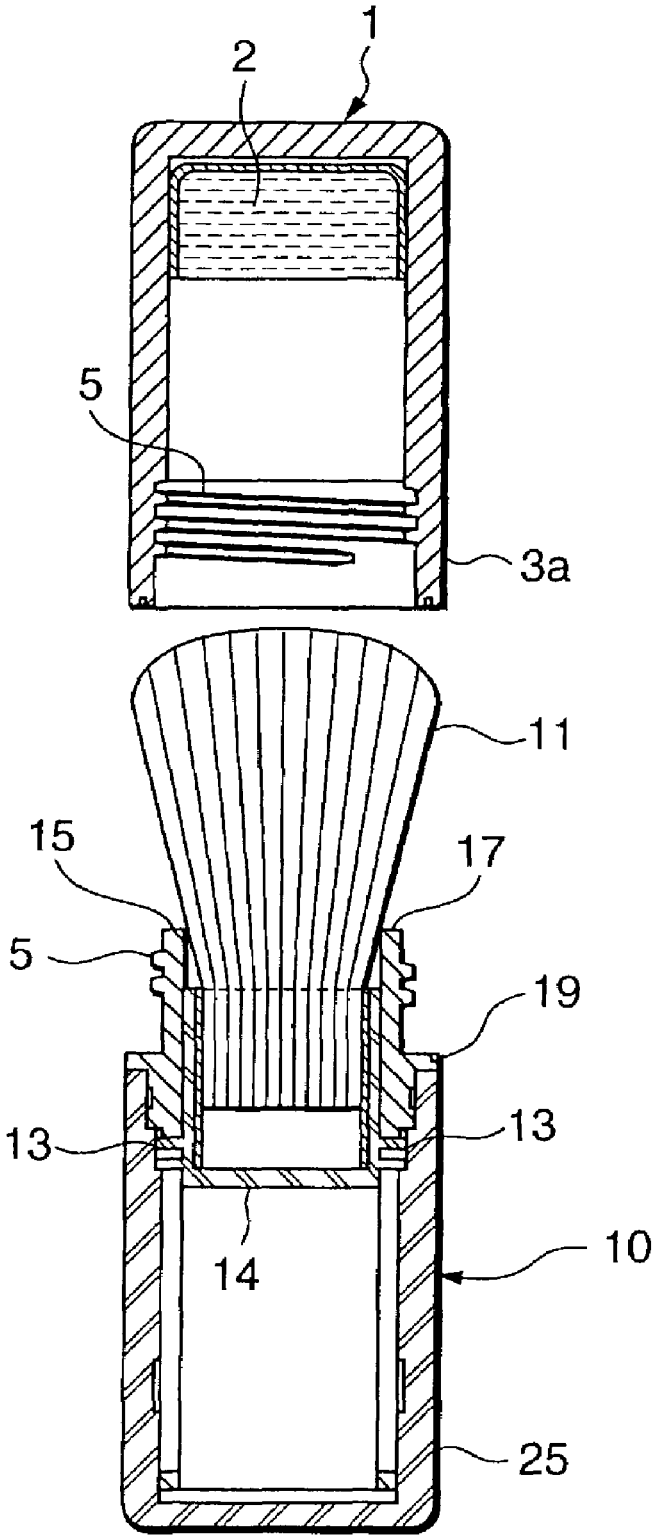
FIG. 5 is a longitudinal sectional view of the cosmetic container of the present invention after completion of removal of the lid element from the main body element.

Under such circumstances, when the lid element 1 is further rotated relative to the outer sleeve 25, as shown in FIG. 4, torque applied by the user is now applied to the fitting engagement mechanism 3 (i.e., threadable engagement mechanism) between the lid element 1 and the main body element 10 so that the lid element 1 is moved upward in a condition in which the main body element 10 held stationary by the user. Eventually, the lid element 1 is disengaged from the main body element 10. Due to this, as is clear from FIG. 5, the user may uses the cosmetic brush 11. As a summary of the above, it is possible for the user to continuously perform a pick-up operation of the cosmetic 2 and a removal operation of the lid element 1 from the main body element 10 only by rotating the lid element 1 in the same direction relative to the main body element 10.

After completion of application of the cosmetic 2 to her or his skin, the user may close the main body element 10 with the lid element 1. More specifically, the user holds the neck portion 17 of the intermediate sleeve 15 by her or his fingers, and rotates the intermediate sleeve 15 in a direction counter to the previous direction relative to the outer sleeve 25 so that the lift sleeve 14 is moved downward to store the cosmetic brush 11 inside the main body portion 10. At this time, the female screw 5 of the lid element 1 is threadably engaged with the male screw 18 of the intermediate sleeve 15 so that the lid element 1 is capable of firmly closing the main body element 10. In this connection, it is preferable to use a packing member disposed adjacent to an upper surface of the flange portion 19 of the intermediate sleeve 15. Such a packing member is capable of hermetically sealing the cosmetic container of the present invention free from any leakage of the cosmetic 2 such as the presto powder.

Second Embodiment

Figure 6:
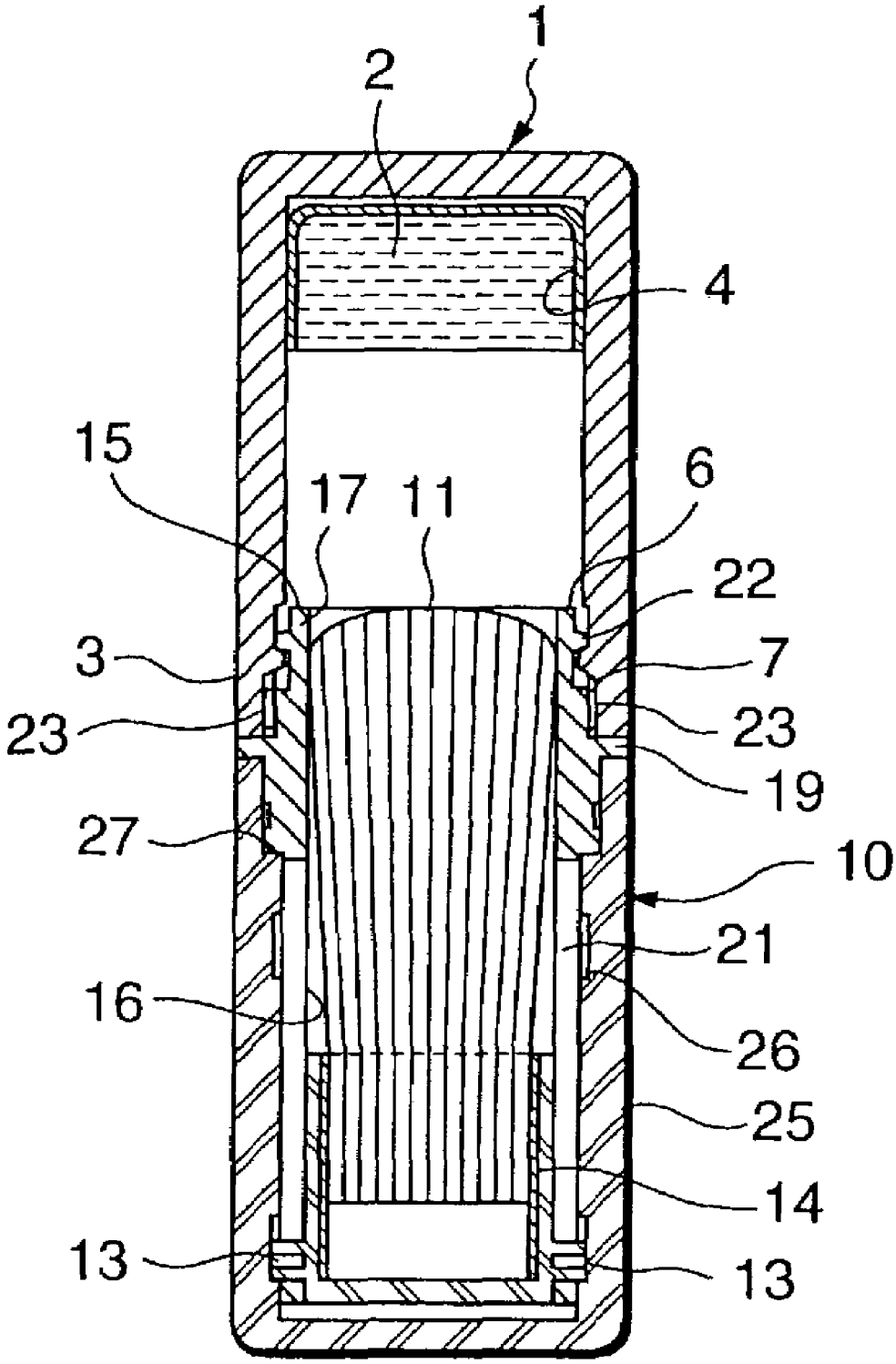
FIG. 6 is a longitudinal sectional view of a second embodiment of the cosmetic container of the present invention.
Figure 7:
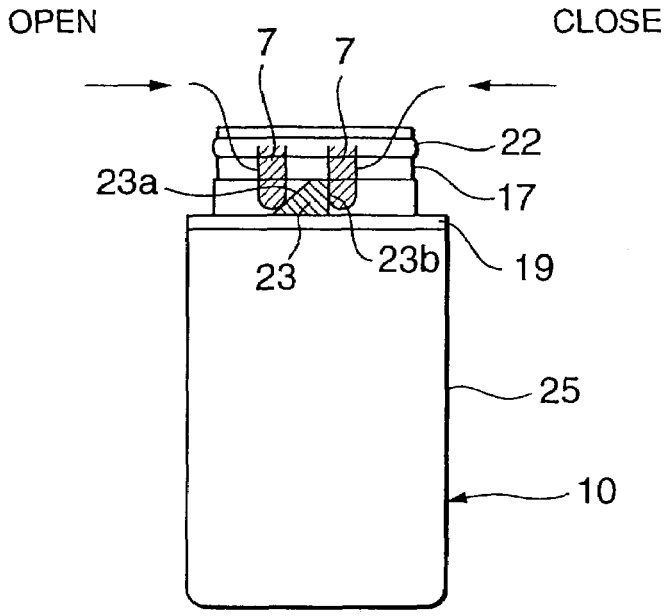
FIG. 7 is a side view of the main body element of the second embodiment shown in FIG. 6, illustrating an essential part of the second embodiment.

FIGS. 6 and 7 show a second embodiment of the cosmetic container of the present invention, which will be now described, wherein components similar to those of the first embodiment will be denoted by similar reference numerals and characters.

In this second embodiment, the fitting engagement mechanism (i.e., threadable engagement mechanism) 3 is constructed of: an engagement structure, in which an annular ridge portion 22 formed in an outer peripheral surface of the neck portion 17 of the intermediate sleeve 15 is fitted in an annular groove 6 formed in an inner peripheral wall of the opening portion 3*a* of the lid element 1; and, a cam mechanism comprising a pair of diametrically opposed cam portions 7 of the lid element 1 and a pair of diametrically opposed ramp portions 23 of the intermediate sleeve 15. Each of the cam portions 7 of the lid element 1 is formed in an inner peripheral surface of the lid element 1 to extend downward from an annular land portion adjacent to the annular groove 6. On the other hand, as is clear from FIG. 7, each of the ramp portions 23 of the intermediate sleeve 15 is formed in an upper surface of the flange portion 19 of the intermediate sleeve 15 to extend upward and assume a wedge-shaped form provided with a slope 23*a* and a vertical surface 23*b*.

As is in the case of the first embodiment, the telescopic mechanism for extending and retracting the cosmetic brush 11 from the opening of the intermediate sleeve 15 is smaller, in torque required in opening operation of the lid element 1, than the fitting engagement mechanism 3 between the annular groove 6 of the lid element 1 and the annular ridge portion 22 of the intermediate sleeve 15. In other words, resistance to disengaging the undercut engagement serves to prevent the cam portions 7 of the lid element 1 from rotating relative to the intermediate sleeve 15. Consequently, when the lid element 1 is rotated in its opening direction by applying torque to the lid element 1, the thus applied torque first operates the telescopic mechanism of the cosmetic brush 11 since the telescopic mechanism of the main body element 10 is smaller in frictional resistance in rotation than the undercut engagement between the lid element 1 and the intermediate sleeve 15.

Consequently, when the telescopic mechanism of the cosmetic brush 11 is operated, the intermediate sleeve 15 is rotated together with the lid element 1 relative to the outer sleeve 25 to move the lift sleeve 14 upward so that the upper end portion of the cosmetic brush 11 is brought into press-contact with the cosmetic 2 stored in the innermost portion of the lid element 1. As a result, a part of the cosmetic 2 of the lid element 1 is transferred to the cosmetic brush 11.

After that, when the lid element is further rotated in the same direction in a condition in which the main body sleeve 10 is held stationary by the user, as is clear from FIG. 7, the cam portions 7 of the lid element 1 ride on the slopes 23*a* of the ramp portions 23 of the intermediate sleeve 15 so that the lid element 1 is moved upward by the ramp portions 23 of the intermediate sleeve 15. This results in disengagement of the undercut engagement between the lid element 1 and the intermediate sleeve 15. Due to this, it is possible for the user to easily remove the lid element 1 from the main body element 10 in use.

After completion of application of the cosmetic 2 to her or his skin, the user may close the main body element 10 with the lid element 1. More specifically, the user holds the neck portion 17 of the intermediate sleeve 15 by her or his fingers, and rotates the intermediate sleeve 15 in a direction counter to the previous direction relative to the outer sleeve 25 so that the lift sleeve 14 is moved downward to store the cosmetic brush 11 inside the main body portion 10. After that, the main body element 10 is capped with the lid element 1. Then, the lid element 1 is pushed down in a condition in which the main body element 10 is held stationary, so that the annular ridge portion 22 of the intermediate sleeve 15 is forcibly fitted into the annular groove 6 of the lid element 1 to establish the undercut engagement between the lid element 1 and the intermediate sleeve 15, whereby the lid element 1 is mounted on the main body element 10 through the intermediate sleeve 15. As is clear from FIG. 7, the vertical surfaces 23*b* of the ramp portions 23 of the intermediate sleeve 15 abut against the corresponding cam portions 7 of the lid element 1 to prevent the lid element 1 from being rotated in a direction counter to the previous direction in which the lid element 1 is rotated relative to the main body element 10 to have the cosmetic brush 11 extended from the opening of the intermediate sleeve 15. In this second embodiment shown in FIG. 7, as described above, the fitting engagement mechanism 3 is constructed of: the undercut engagement between the lid element land the main body element 10; and, the cam mechanism for disengaging the undercut engagement. Due to this, it is possible for the user to have the lid element 1 engaged with and disengaged from the main body element 10 in a very easy manner.

Figure 8:
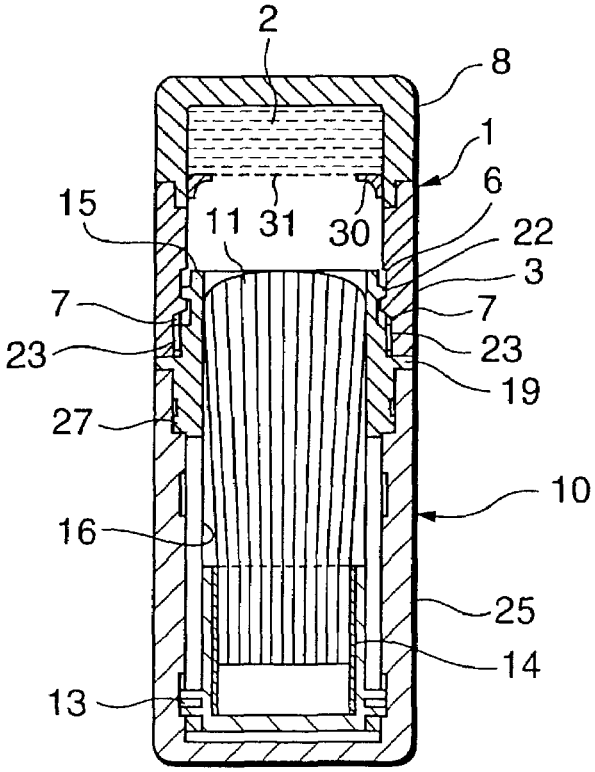
FIG. 8 is a longitudinal sectional view of a modification of the second embodiment shown in FIG. 6, illustrating another application of the cosmetic of a different type.

FIG. 8 shows a modification of the second embodiment shown in FIG. 7. In this modification, the cosmetic 2 is of a powder type. More specifically, as is clear from FIG. 8, the lid element 1 is constructed of: a cartridge 8, which is disposed in an upper portion of the lid element and capable of being disengaged from the remaining lower portion of the lid element 1. The cartridge 8 is filled with the powdery cosmetic 2, and fixedly mounted on an upper end portion of the lower portion of the lid element 1 by means of a screen member 31 which is firmly held and expanded by an annular frame element 30 inside the cartridge 8. The frame element 30 is axially adjustable in position along the axis of the cartridge 8. Consequently, the cartridge 8 having the above construction forms the innermost portion of the lid element 1 thus assembled with the cartridge 8.

Due to the above construction of the lid element 1 assembled with the cartridge 8, it is possible to compact the powdery cosmetic 2 into less space. This compactness of the powdery cosmetic 2 is advantageous in portable use of the cosmetic container of the present invention. In the modification of the second embodiment, as is clear from FIG. 8, it is possible to pick up the powdery cosmetic 2 by the cosmetic brush 11. More specifically, the cosmetic brush 11 is moved upward inside the cosmetic container and brought into press-contact with the powdery cosmetic 2 of the cartridge 8 to pick up a part of the powdery cosmetic 2 when the lid element 1 is rotated in the previous direction relative to the main body element 10 which is held stationary and still capped with the lid element 1. Since the powdery cosmetic 2 stored in the cartridge 8 is gravity-fed downward to the cosmetic brush 11 through the screen member 31 of the cartridge 8 in this modification (shown in FIG. 8) of the second embodiment, it is possible for the user to consume all the powdery cosmetic 2 stored in the cartridge 8 without fail. It is also possible for the user of the modification of the second embodiment to replace the used cartridge 8 with a new one in an easy manner.

Third Embodiment

Figure 9:
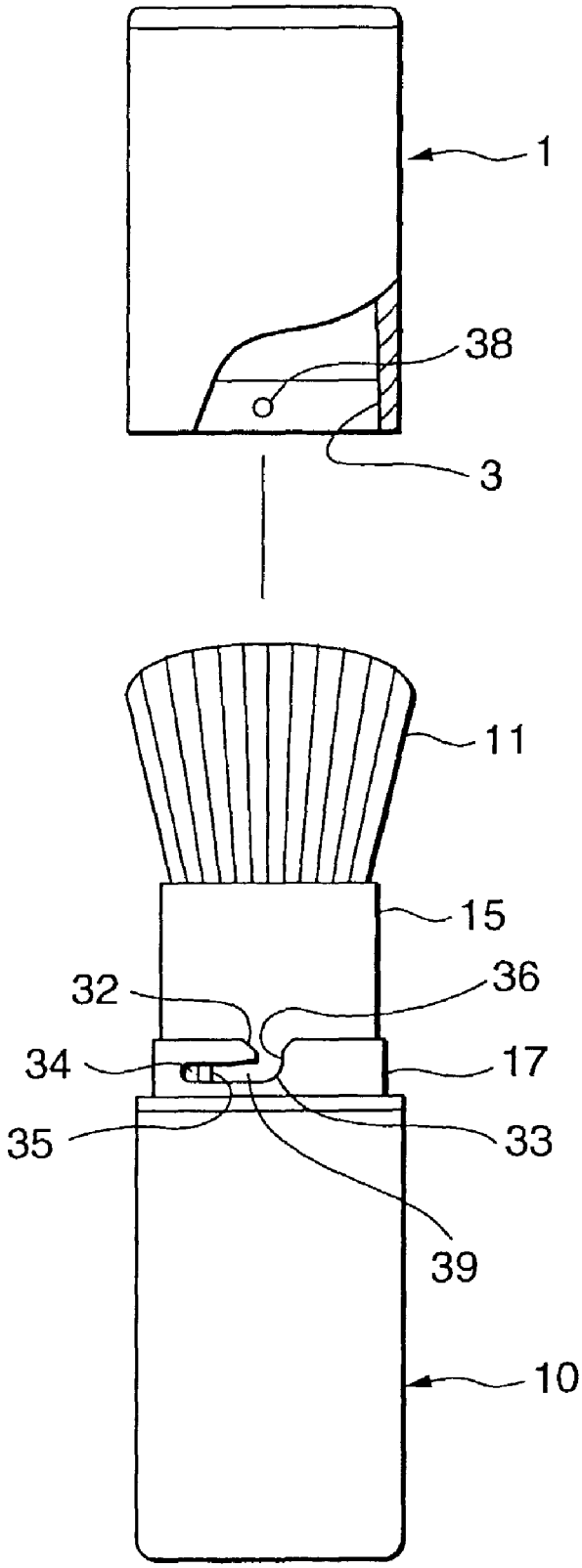
FIG. 9 is a side view of a third embodiment of the cosmetic container of the present invention, illustrating an essential part of the third embodiment.

FIG. 9 shows a third embodiment of the cosmetic container of the present invention. As is clear from FIG. 9, in this third embodiment, the fitting engagement mechanism 3 is constructed of: a pair of diametrically opposed pins 38 fixedly mounted in an inner peripheral surface of the opening portion 3*a* of the lid element 1 to extend radially inwardly; and, a pair of diametrically opposed L-shaped slots 39 formed in an outer peripheral surface of the neck portion 17 of the intermediate sleeve 15 fitted in the main body element 10, wherein each of the L-shaped slots 39 slidably received therein each of the corresponding pins 38 of the lid element 1.

The L-shaped slot 39 of the intermediate sleeve 15 comprises: an entrance guide portion 32 forming an entrance of the L-shaped slot 39, through which guide portion 32 the pin 38 of the lid element 1 slidably enters the L-shaped slot 39 when the main body element 10 is capped with the lid element 1; an oblique guide portion 33 subsequent to the entrance guide portion 32, through which oblique guide portion 33 the pin 38 of the lid element 1 is guided toward an innermost guide portion 34 of the L-shaped slot 39; and, a locking rib 35, by which the innermost guide portion 34 is separated from the remaining portion of the L-shaped slot 39. The locking rib of the L-shaped slot 39 slightly interferes with a free end of the pin 38 of the lid element 1 when the lid element 1 is rotated to have its pins 38 slidably moved in the length of the L-shaped slots 39 toward their innermost guide portions 34.

More specifically, when the lid element 1 is rotated so as to have its pin 38 slidably moved in the length of the L-shaped slot 39 toward its innermost guide portion 34, the pin 38 of the lid element 1 thus rotated is brought into press-contact with the locking rib 35 of the intermediate sleeve 15, and then radially outwardly pushed by the locking rib 35 to ride across the locking rib 35 to enter the innermost portion 34 of the L-shaped slot 39 due to the resiliency of the lid element 1. Once the pin 38 of the lid element 1 enters the innermost portion of the L-shaped slot 39 of the intermediate sleeve 15, the pin 38 immediately returns to its normal position due to the resiliency of the lid element 1 and is therefore locked to the innermost portion of the L-shaped slot 39.

On the other hand, when the lid element 1 is rotated in a direction counter to the previous direction relative to the main body element 10 held stationary, the cosmetic brush 11 is moved upward in he main body element 10 since the pin 38 of the lid element 1 is locked to the innermost portion of the L-shaped slot 39 of the intermediate sleeve 15 due to the provision of the locking rib 35 in the intermediate sleeve 15, the intermediate sleeve 15 is also rotated together with the lid element 1. As a result, the cosmetic brush 11 has its upper end portion brought into press-contact with the cosmetic 2 of the lid element 1. Due to this press-contact between the cosmetic brush 11 and the cosmetic 2, a part of the cosmetic 2 is transferred to the cosmetic brush 11. At the same time, the intermediate sleeve 15 is prevented from rotating relative to the main body element 10.

Under such circumstances, when the lid element 1 is further rotated in the same direction, the pin 38 of the lid element 1 is radially outwardly pushed by the locking rib 35 of the intermediate sleeve 15 to ride across the locking rib 35 due to the resiliency of the lid element 1. After that, the pin 38 of the lid element 1 is guided to the entrance guide portion 32 of the L-shaped slot 39 of the intermediate sleeve 15, and then released from the intermediate sleeve 15. As is clear from the above description, in the third embodiment of the present invention shown in FIG. 9, it is possible for the user to have the lid element 1 engaged with and disengaged from the main body element 10 in an easy manner.

Incidentally, when the L-shaped slot 39 of the intermediate sleeve 15 is provided with a vertical guide portion 36 between the entrance guide portion 32 and the oblique guide portion 33 of the slot 39, it is possible to increase the pressure of the cosmetic brush 11 applied to the cosmetic 2 in proportion to a length of the vertical guide portion 36 of the slot 39 since only deformation of the cosmetic brush 11 is permitted until the pin 38 of the lid element 1 is released from the L-shaped slot 39 of the intermediate sleeve 15. Consequently, it is possible to adjust the length of the vertical guide portion 36 of the L-shaped slot 39 depending upon individual application of various types of cosmetics 2.

Fourth Embodiment

Figure 10:
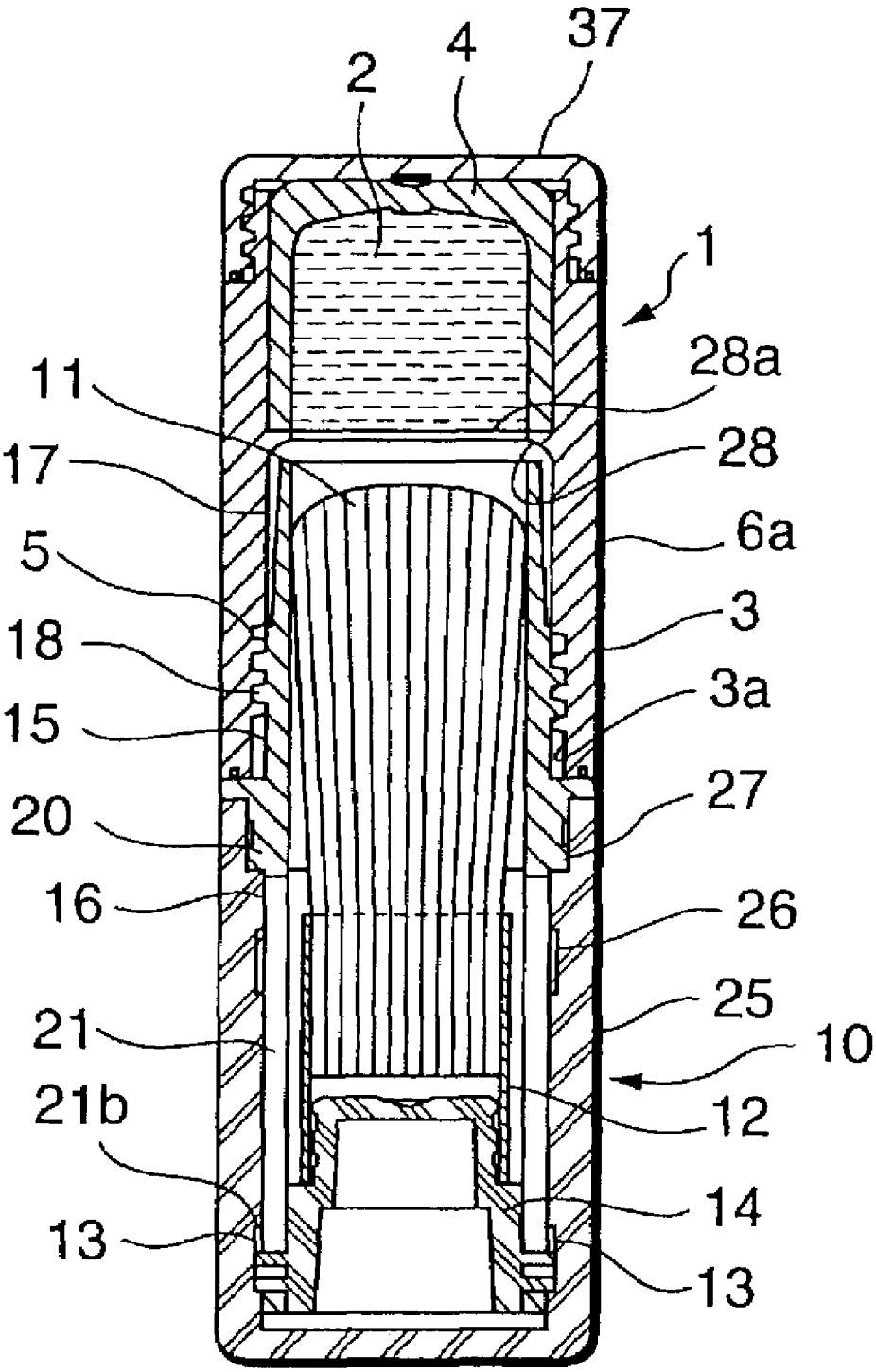
FIG. 10 is a longitudinal sectional view of a fourth embodiment of the cosmetic container of the present invention, illustrating the lid element of another type.
Figure 11:
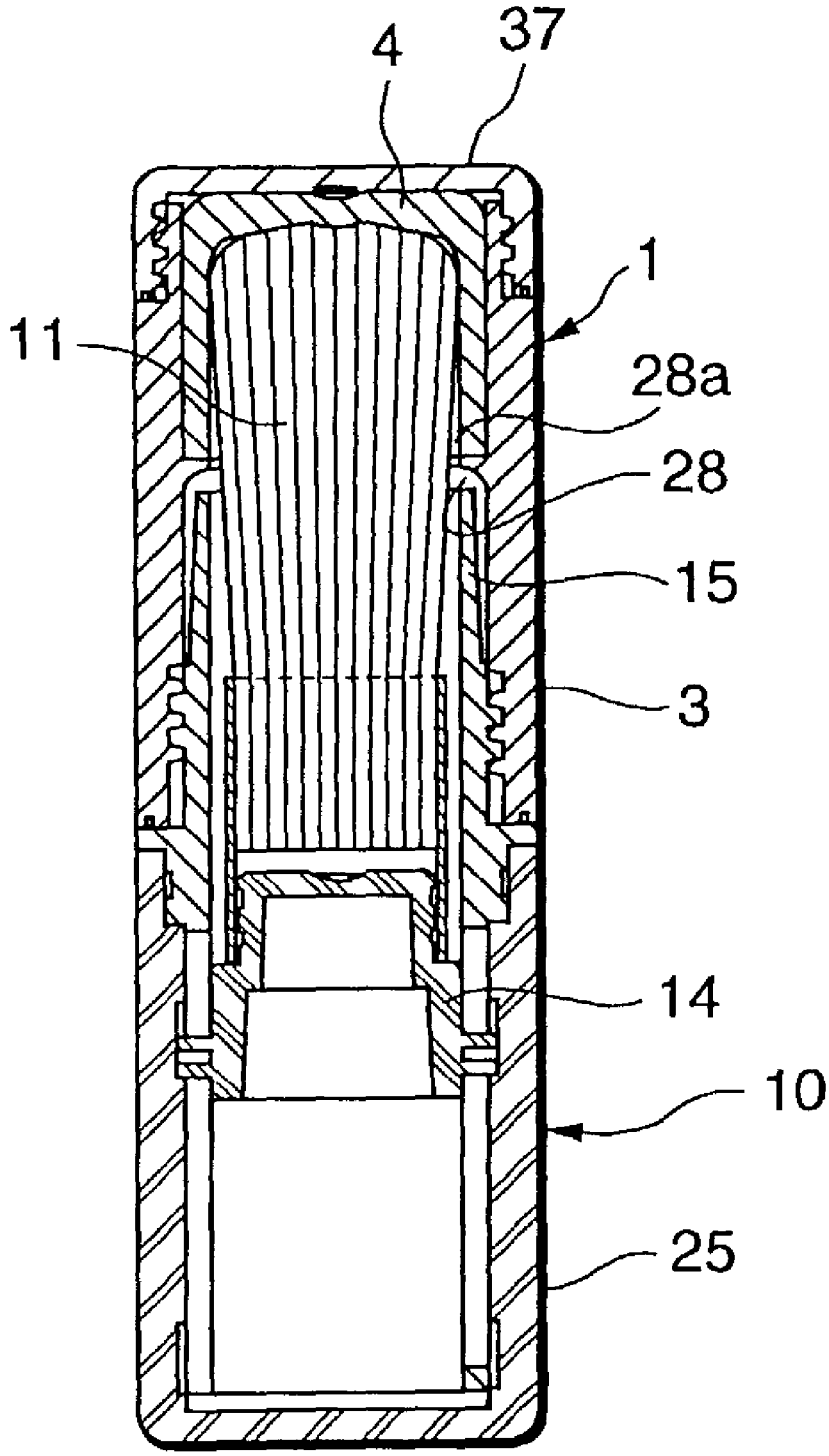
FIG. 11 is a longitudinal sectional view of the fourth embodiment shown in FIG. 10, illustrating a lifted position of the cosmetic brush.
Figure 12:
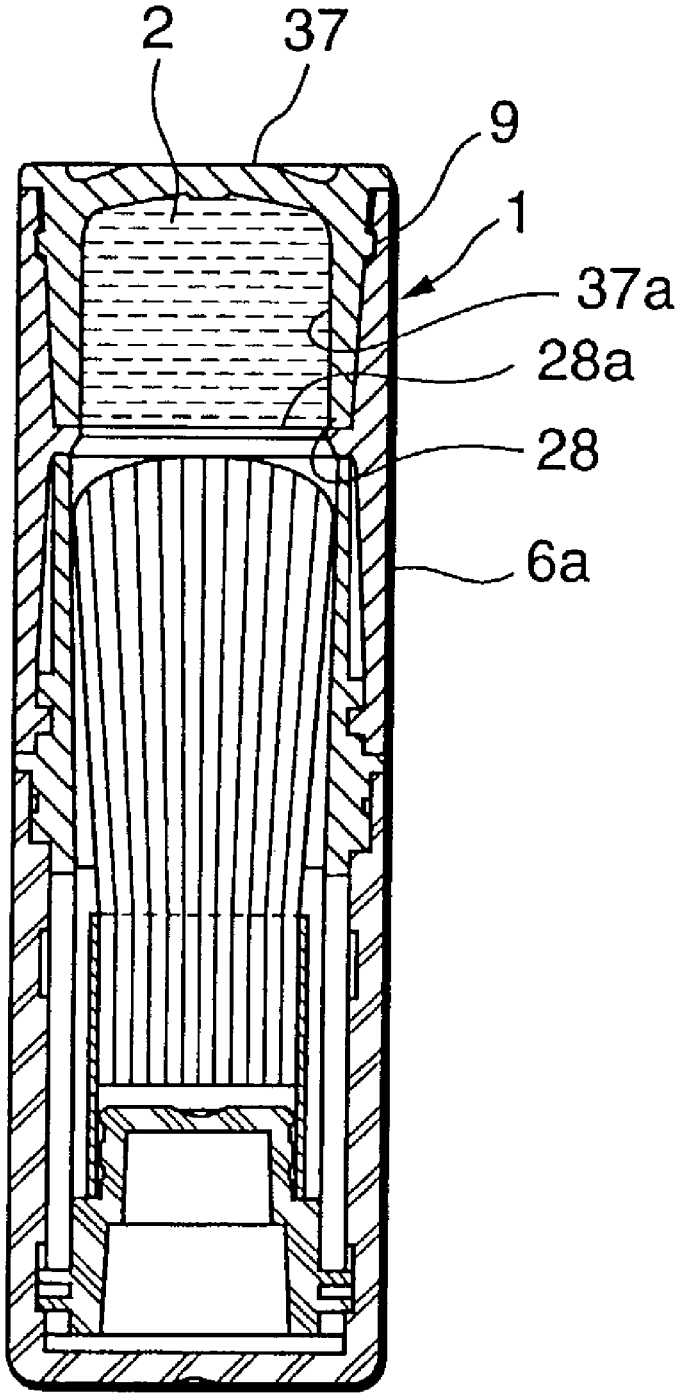
FIG. 12 is a longitudinal sectional view of a modification of the fourth embodiment shown in FIG. 10, illustrating the lid element of further another type.

FIGS. 10 to 12 show a fourth embodiment of the present invention. In this fourth embodiment, as shown in FIG. 10, the lid element 1 is provided with an annular guide portion 28 in an inner peripheral surface of its barrel portion **6*a*. As is clear from FIG. 10, the annular guide portion 28 of the lid element 1 has its upper surface extend in a direction perpendicular to a longitudinal axis of the lid element 1 and its lower surface inclined upward toward the longitudinal axis of the lid element 1 in cross section. The upper surface of the annular guide portion 28 of the lid element 1 forms an annular shoulder portion 28*a*. An inner dish 4, which is filled with the cosmetic 2 such as a presto powder or the like, is fixedly mounted on the annular shoulder portion 28*a* of the lid element 1 inside the lid element 1. In lifting operation of the cosmetic brush 11, when the cosmetic brush 11 is moved upward relative to the main body element 10, the cosmetic brush 11 has its upper end portion converged on the longitudinal axis of the lid element 1 by means of the oblique lower surface 28 of the annular guide portion 28 of the lid element 1 and then brought into press-contact with the cosmetic 2 in the thus converged state. In this fourth embodiment, as is clear from FIG. 10, the lid element 1 is provided with a ceiling member 37 which is threadably engaged with an upper end portion of the lid element 1 to form the innermost portion of the lid element 1. Mounted in this inmost portion of the lid element 1 is the inner dish 4 filled with the cosmetic 2. Consequently, it is possible for the fourth embodiment to refill the inner dish with the cosmetic 2 by removing the ceiling member 37 from the lid element 1**.

In the fourth embodiment, as is clear from FIG. 10, the upper end portion of the cosmetic brush 11 thus moved upward relative to the lid element 1 is guided by the convergent guide portion 28 of the lid element 1 to reach the cosmetic 2 of the inner dish 4 of the lid element 1. In the above, since the upper end portion of the cosmetic brush 11 passes through the convergent guide portion 28 of the lid element 11 before reaching the cosmetic 2 of the inner dish 4 of the lid element 2, the upper portion of the cosmetic brush 11 is formed into a convergent shape, and is therefore prevented from assuming the mushroom-like shape when brought into press-contact with the cosmetic 2 of the lid element 1. Due to this, there is no fear that the press-contact between the cosmetic brush 11 and the cosmetic 2 causes damage to the upper end portion of the cosmetic brush 11. Further, there is also no fear that the excessive amount of the cosmetic 2 of the lid element 1 is transferred to the upper end portion of the cosmetic brush 11. Further, as is clear from FIG. 11, even when the amount of the cosmetic 2 stored in the lid element 1 is considerably reduced in use, the upper end portion of the cosmetic brush 11 is capable of reaching the cosmetic 2 of the inner dish 4 of the lid element 1 since the upper end portion of the cosmetic brush 11 passes through the convergent guide portion 28 of the lid element 1 to assume the convergent shape which makes it possible for the cosmetic brush 11 to reach the cosmetic 2 without being damaged in its upper end portion.

FIG. 12 shows a modification of the fourth embodiment shown in FIG. 10. In this modification, the cosmetic 2 is filled in a cap member 37. The cap member 37 is suitable for storing therein a non-refill type of the cosmetic 2. As shown in FIG. 12, the cosmetic 2 is stored in a sleeve portion **37*a*** of the cap member 37. The cap member 37 is fixedly mounted inside an upper opening of the lid element 1 in a manner such that the cap member 37 has its outer peripheral portion engaged with an inner peripheral surface of the barrel portion 6*a* of the lid element 1 through what is known as the undercut engagement 9 in the art. More specifically, in this undercut engagement 9, as is clear from FIG. 12, an annular ridge portion formed in the outer peripheral surface of the cap member 37 is fitted in an annular groove (i.e., undercut) portion formed in the inner peripheral surface of the barrel portion 6*a* of the lid element 1. This type of the lid element 1, which is provided with the cap member 37, may reduce the number of its components and also improve its assembly work in efficiency and in assembly speed.

Finally, the present application claims the Convention Priority based on Japanese Patent Application No. 2002-329517 filed on Nov. 13, 2002, which is herein incorporated by reference. Japanese Patent Application No. 2001-223938 filed on Jul. 25, 2001, is also herein incorporated by reference.

What is claimed is:

1. A cosmetic container comprising:

a lid element (1) provided with an innermost portion and an opening portion (3*a*), stored in which innermost portion is a cosmetic (2), said opening portion (3) being provided with a fitting engagement portion; and, a main body element (10), in which a cosmetic brush (11) is extensibly mounted, said main body element (10) being capable of engaging with said lid element (1) in an insertion manner, characterized in that:

said main body element (10) is provided with a telescopic mechanism for extending and retracting said cosmetic brush (11) from an upper opening of an intermediate sleeve (15), said telescopic mechanism being constructed of: a lift sleeve (14) provided with a protrusion (13) extending radially outwardly from an outer peripheral surface of said lift sleeve (14), the lift sleeve (14) mounted with a cosmetic brush (11) disposed therein; said intermediate sleeve (15) in which said lift sleeve (14) is axially slidably received, said intermediate sleeve (15) being provided with a neck portion (17) in its upper portion and a sleeve portion (16) in its lower portion, wherein said sleeve portion (16) is provided with an elongated axial guide groove (21) in its peripheral wall for axially slidably receiving therein said protrusion (13) of said lift sleeve (14) and said neck portion (17) is provided with an engagement portion which is engaged with a corresponding engagement portion of said lid element (1) to form a fitting engagement mechanism (3) through which said intermediate sleeve (15) is engaged with said lid element (1) in an insertion manner; and, an outer sleeve (25) in which said intermediate sleeve (15) is rotatably but not axially movably mounted, said outer sleeve (25) being provided with a spiral groove (26) in its inner peripheral surface, said protrusion (13) of said lift sleeve (14) simultaneously is slidably received through said axial guide groove (21) of said intermediate sleeve (15) and is slidably engaged with said spiral groove (26) of said outer sleeve (25), wherein said telescopic mechanism of said main body element (10) is smaller in frictional resistance in rotation than said fitting engagement mechanism (3) through which said intermediate sleeve (15) is engaged with said lid element (1) in an insertion manner such that the lift sleeve (13) moves serially from a locked retracted state, then to an unlocked retracted state, then to an unlocked extended state and then to a locked extended state, wherein when the lid element (1) and the main body element (10) are first rotated relative to each other, the lift sleeve (13) moves from the locked retracted state to the unlocked retracted state without axial movement of the lift sleeve (13), thereafter, when the lid element (1) and the main body element (10) continue to rotate relative to each other, the lift sleeve (13) moves axially from the unlocked retracted state to the unlocked extended state where an upper portion of the cosmetic brush (11) is brought into press contact with the cosmetic (2), thereafter when the lid element (1) and the main body element (10) continue to rotate relative to each other, the lift sleeve (13) moves from the unlocked extended state to the locked extended state without axial movement of the lift sleeve (13) while the upper portion of the cosmetic brush (11) remains in press contact with the cosmetic (2) and thereafter the lid element (1) and the main body element (10) continue to be rotated relative to each other until the lid element (1) and the main body element (10) disengage from each other.

2. The cosmetic container as set forth in claim 1, wherein said fitting engagement mechanism (3) is constructed of: a female screw (5) formed in an inner peripheral surface of said opening portion (3*a*) of said lid element (1); and, a male screw (18), which is formed in an outer peripheral surface of said neck portion (17) of said intermediate sleeve (15) and threadably engaged with said female screw (5) of said lid element (1).

3. The cosmetic container as set forth in claim 1, wherein said fitting engagement mechanism (3) is constructed of: an undercut engagement(9) between said lid element (1) and said main body element (10); and, a cam mechanism for disengaging said undercut engagement.

4. The cosmetic container as set forth in claim 1, wherein said fitting engagement mechanism (3) is constructed of: a pin (38) fixedly mounted in said lid element (1) to extend radially; and, an L-shaped slot (39) formed in said intermediate sleeve (15) to slidably receive therein said pin (38) of said lid element (1), said L-shaped slot (39) comprising an oblique guide portion (33) and a locking rib (35), wherein said oblique guide portion (33) of said L-shaped slot (39) functions to guide said pin (38) of said lid element (1) upward relative to said intermediate sleeve (15), wherein, when said lid element (1) is rotated so as to have said pin (38) slidably moved in the length of said L-shaped slot (39) toward an innermost portion (34) of said L-shaped slot (39), said pin (38) is brought into press-contact with said locking rib (35), and then radially pushed by said locking rib (35) to ride across said locking rib (35) to enter said innermost portion (34) of said slot (39) due to the resiliency of said lid element (1), wherein, once the pin (38) of said lid element (1) enters said innermost portion (34) of said L-shaped slot (39), said pin 38 immediately returns to its normal position due to the resiliency of said lid element (1) and is locked to said innermost portion (34) of said L-shaped slot (39).

5. The cosmetic container as set forth in any one of claims 1 to 4, wherein said lid element (1) is constructed of: a cap member (37) filled with said cosmetic (2); and, a barrel portion (6*a*) of said lid element (1), said barrel portion (6*a*) being engaged with said cap member (37) through undercut engagement (9) in which an annular ridge portion formed in an outer peripheral surface of said cap member (37) is fitted in an annular groove formed in an inner peripheral surface of said barrel portion (6*a*) of said lid element (1).

6. The cosmetic container as set forth in any one of claims 1 to 4, wherein said lid element (1) is provided with an annular convergent guide portion (28) in its inner peripheral surface, through which convergent guide portion (28) said cosmetic brush (11) has its upper end portion converged radially inwardly toward a longitudinal axis of said lid element (1).

* * * * *